United States Patent [19]

Hanazawa et al.

[11] 4,263,769

[45] Apr. 28, 1981

[54] PROCESS FOR MAKING COLLECTIVE PACKING BOXES

[76] Inventors: Sadao Hanazawa, 270 Michinobe, Kamagaya-shi, Chiba; Seiji Naruse, 2848-239 Kubota, Sodegaura-machi, Kimitsu-gun, Chiba; Yoshio Nagao, 2-29-102 Ayamedai, Chiba-shi, Chiba; Naoji Taguchi, 1397-176 Shikota, Kashiwa-shi, Chiba; Makoto Majima, 2-19-1 Kugayama, Suginami-ku, Tokyo, all of Japan

[21] Appl. No.: 60,628

[22] Filed: Jul. 25, 1979

[30] Foreign Application Priority Data

Jul. 31, 1978 [JP] Japan ..... 53-92478

[51] Int. Cl.[3] ..... B65B 35/40; B65B 35/54

[52] U.S. Cl. ..... 53/448; 229/15; 53/542

[58] Field of Search ..... 53/447, 448, 458, 443, 53/485, 486, 488, 445, ,437, 542, 452, 169, 525, 538, 558, 539, 540, 543, 152, 589, 158, 159, 168, 582, 299, 383; 229/15; 206/460; 156/315; 93/37 SP

[56] References Cited

U.S. PATENT DOCUMENTS

| | | | |
|---|---|---|---|
| 529,228 | 11/1894 | Wyler | 229/15 UX |
| 2,098,090 | 11/1937 | Ford | 229/15 |
| 2,651,153 | 9/1953 | Burnett | 53/445 X |
| 3,185,379 | 5/1965 | Kohlhaas | 229/15 X |
| 3,416,286 | 12/1968 | Ciccone | 53/542 X |
| 3,447,733 | 6/1969 | Smith et al. | 229/15 X |
| 3,543,991 | 12/1970 | George | 229/15 |
| 4,157,754 | 6/1979 | Bartsch et al. | 53/383 X |
| 4,177,895 | 12/1979 | Shelton | 229/15 X |
| 4,185,763 | 1/1980 | Geraedts | 229/15 |
| 4,186,846 | 2/1980 | Jacalone et al. | 229/15 X |

*Primary Examiner*—Horace M. Culver
*Attorney, Agent, or Firm*—Armstrong, Nikaido, Marmelstein & Kubovcik

[57] ABSTRACT

A process for making collective packing unit boxes, comprising the steps of feeding a plurality of unit boxes by a first conveyor, thrusting the unit boxes one by one from the first conveyor to a second conveyor perpendicular thereto, thereby to cause the front side of each unit box to contact with the backside of the immediately preceding unit box, respectively, collecting a predetermined number of unit boxes together when the unit boxes are thrust from the first conveyor to the second conveyor, bringing down two flaps extending from the opposite edges of the collected unit boxes inwards, daubing an adhesive on the top flaps of the unit boxes, daubing an adhesive on the upper portions of the two sides of each unit box perpendicular to the contacting sides thereof, pressing a common lid onto the top of the collected predetermined number of unit boxes so that the lid may be adhered on the top flaps of the collected unit boxes, and folding the two opposite side edges of the lid so that the side edges are adhered on the upper portions of the two sides of the collected unit boxes.

6 Claims, 9 Drawing Figures

PROCESS FOR MAKING COLLECTIVE PACKING BOXES

BACKGROUND OF THE INVENTION

The present invention relates to a process for making collective packing boxes for collectively transferring and storing plural unit boxes.

For the collective transfer and storage of plural unit boxes containing miscellaneous goods or the like, conventionally the unit boxes are packed in another bigger packing box made of corrugated cardboard or the like. Such a double packing, however, is a waste of packing materials and packing labor, and furthermore is cumbersome for the occasions wherein not all of the unit boxes contained in the cardboard box are used. For example, in such a case the necessary number of unit boxes must be taken out of the cardboard box and re-packed for the transfer thereof.

SUMMARY OF THE INVENTION

Therefore, it is an object of the present invention to provide a process for making economical collective packing boxes in which the foregoing problem is solved.

According to the present invention, there is provided a process for making collective packing unit boxes, comprising the steps of feeding a plurality of unit boxes by a first conveyor, thrusting the unit boxes one by one from the first conveyor to a second conveyor perpendicular thereto, thereby to cause the front side of each unit box to contact with the backside of the immediately preceding unit box, respectively, collecting a predetermined number of unit boxes together when the unit boxes are thrust from the first conveyor to the second conveyor, bringing down two flaps extending from the opposite edges of the collected unit boxes inwards, daubing an adhesive on the top flaps of the unit boxes, daubing an adhesive on the upper portions of the two sides of each unit box perpendicular to the contacting sides thereof, pressing a common lid onto the top of the collected predetermined number of unit boxes so that the lid may be adhered on the top flaps of the collected unit boxes, and folding the two opposite side edges of the lid so that the side edges are adhered on the upper portions of the two sides of the collected unit boxes.

BRIEF DESCRIPTION OF THE DRAWINGS

Other objects, features and advantages of the present invention will become more apparent from the following description of preferred embodiments of the present invention when taken in conjunction with the accompanying drawings in which.

DETAILED DESCRIPTION OF THE PREFERRED EMBODIMENTS

Figure 1:
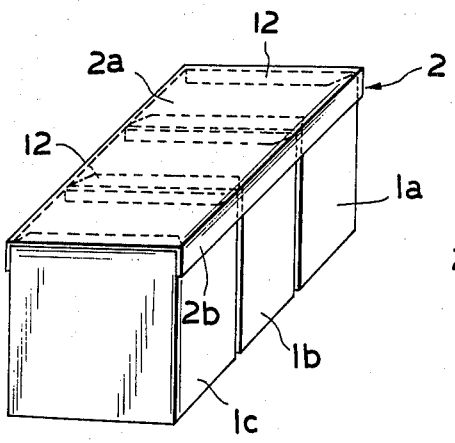
FIG. 1 is a perspective view showing an example of the collective unit packing boxes produced according to a preferred embodiment of the present invention.
Figure 2:
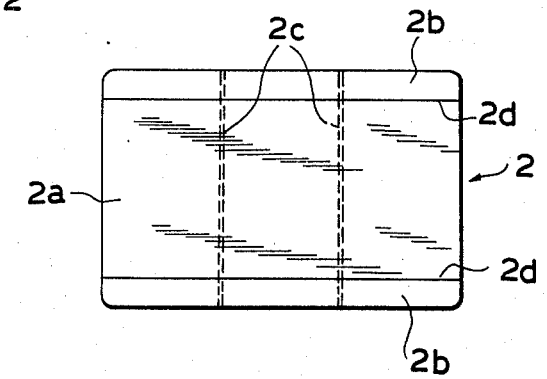
FIG. 2 is a developed view of a lid which is used to be adhered to the collective unit boxes according to the present invention, by way of example.

FIGS. 1 and 2 show collective packing boxes which Naoji Taguchi et al previously developed. The collective packing boxes are made by collecting plural unit boxes and applying a lid common to the collected boxes as disclosed in the pending Japanese Utility Model Applications Nos. 3013/77 and 154052/77. The collective packing boxes consist of plural hexahedral containers with open tops, each accommodating the goods, which are collected and applied with a common lid and whereby integrated for the transfer and storage. As shown in FIG. 1, for example, three unit boxes 1*a*, 1*b* and 1*c* may be combined, with their open tops being covered by a common lid 2, thereby to make integral packing boxes. The packing boxes can be separated into the individual containers each with the lid 2 whenever desired. For example, in the lid 2 as shown in FIGS. 1 and 2, the two opposite edges are extended beyond the folding lines 2*d* to provide the edges 2*b* to be adhered to the unit boxes 1*a*, 1*b*, 1*c*. The parts corresponding to the boundary lines of the unit boxes 1*a*, 1*b* and 1*c* are made into the cutting portions 2*c* which may be made of notched tape or the like, to facilitate the separation into the unit boxes. Thus not only the conventional double packing is avoided, but also the lids of individual containers are dispensed with because a common lid is used. Thus the packing material and packing labor can be saved compared with the conventional packing boxes. Furthermore, such collective boxes can be separated into the individual containers with no damage, simply by cutting the common lid, allowing the containers after the separation to be handled similarly to the conventional unit box.

The present invention provides a process for making such advantageous collective boxes.

Figure 3:
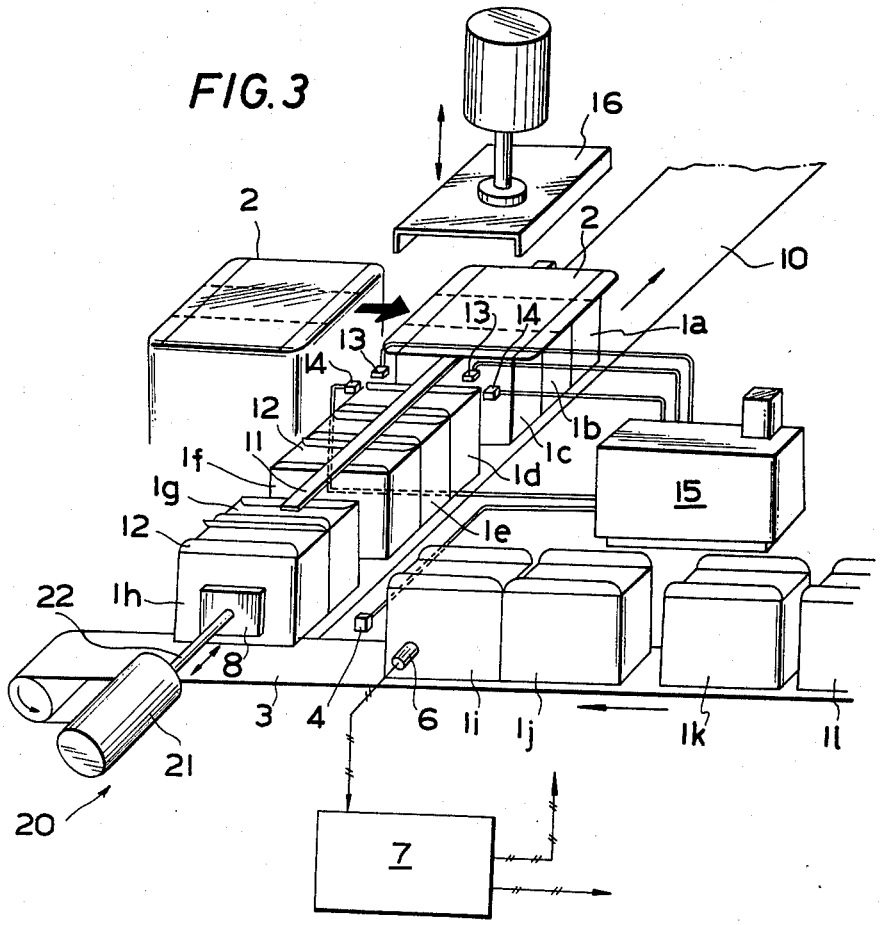
FIG. 3 is a schematic perspective view showing an apparatus for practing a method according to an embodiment of the present invention.

FIG. 3 shows an apparatus for practicing the process of producing such collective packing boxes by way of example. In the illustrated apparatus, the unit boxes 1*a*, 1*b*, 1*c* . . . are sequentially supplied by a conveyor such as a belt conveyor 3 in the direction of left hand in the figure. An adhesive applying head 4 is located near one side of the conveyor 3 to daub an adhesive onto each side 5 (5*a*, 5*b*, 5*c* . . . ) of the unit boxes which are being transferred. A detector 6 is provided near the other side of the conveyor 3 a little bit ahead of the head 4 to detect that each unit boxes come to a predetermined position along the belt conveyor. The detector 6 may be a phototube, a microswitch or the like. A controller 7 is connected to both the detector 6 and an actuator (not shown) for actuating the adhesive applying head 4 to selectively apply the adhesive on one side of the unit boxes when the detection signal is sent from the detector 6 to the controller. The controller 7 may be a disital controller which has a selective actuating function so that the adhesive can be applied only to the selected boxes in a predetermined order when they pass by the head 4. For example, of the three consecutively moving unit boxes, two only are continuously applied with the adhesive. In the illustrated embodiment, the adhesive applying head 4 is selectively actuated by the controller 7 to daub the adhesive to only the unit boxes 1*b* and 1*c*, 1*e* and 1*f*, . . . when the unit boxes 1*a*, 1*b*, 1*c*, 1*d*, 1*e*, 1*f*, 1*g* . . . pass by the head 4, and then no adhesive is applied to the other unit boxes 1*a*, 1*d*, 1*g*, . . . . Both detection signals from the detector 6 and the control signals from the controller 7 can be sent by any of electrical, pneumatic or mechanical means.

Next to the adhesive applying head 4, a thrusting means 20 is provided to thrust each unit boxes forwards. The thrusting means 20 comprises a thrusting plate 8, a cylinder 21 and a rod 22 actuated by the cylinder 21, the front end of the rod 22 being fixed to the plate 8. At the same point, a conveyor 10 is positioned to run in the direction perpendicular to that of the conveyor 3. The unit boxes 1*a*, 1*b*, 1*c* . . . which have passed by the application head 4 are thrust out onto the conveyor 10 by the thrusting plate 8 which makes a reciprocal motion in the same direction with said conveyor 10 and thrusts the sides 9 (9*a*, 9*b*, 9*c*, . . . ) of the unit boxes which are opposite to the adhesive-applied sides 5 (5*a*, 5*b*, 5*c*, . . . ). The running speed of the conveyor 10 is slightly lower than that of the conveyor 3, so that the unit boxes 1*a*, 1*b*, 1*c*, . . . which have been thrust out by the plate 8 catch up with the respectively preceding boxes. A stopper (not shown) is provided across the conveyor 3 near the left end thereof to stop the unit boxes in position before they are thrust by the thrusting means 20. Thus the thrust unit boxes are properly aligned on the conveyor 10. When the plate 8 thrusts the unit boxes on the conveyor 3 to those on the conveyor 10, the sides of the three boxes come to contact. For example, the sides 9*a*, 9*b* and 9*c* come to contact with the sides 5*b*, 5*c*, and 5*d*, respectively. Thus the unit boxes 1*a*, 1*b*, 1*c* are collected along the thrust out direction, i.e., every three unit boxes are integrated. This step will be explained in detail referring to FIGS. 4(I) through 4(VIII).

A bar 11 for bending the top flaps 12 extending from the opposite top edges of the unit boxes is provided over the conveyor 10 along the running direction of the conveyor 10. During the transfer of the unit boxes collected by the predetermined number, for example, three in the illustrated embodiment, on the conveyor 10, the flap bending bar 11 depresses the flaps 12 inwards as shown in FIG. 3. Another adhesive applying heads 13 disposed in connection with the bar 11 daubs the adhesive on the flaps 12 when they pass the head 13. At the same time, another adhesive applying head 14 positioned above each side of the conveyor 10 near the heads 13 applies the adhesive on the upper portions of the two opposite sides of the three unit boxes perpendicular to the adhered sides 5 and 9 of the unit boxes 1*a*, 1*b*, 1*c* . . . .

Near the terminal of the flap bending bar 11, one of the stuck lids 2 is supplied to each of the collected unit boxes of the predetermined number by a conventional feeding machine (not shown) and then pressed onto the top of the three collected unit boxes by means of a forming plate 16 which is designed to move up and down so as to adhere one common lid onto the flaps 12 of the three collected unit boxes. Also, the edges 2*b* on the both sides of the lid 2 are bent and adhered to the upper portion of the both sides of the unit boxes. Thus one collective packing boxes become complete. Such formed collective packing boxes are sequentially detached from the flap bending bar 11 and transferred to a next stage for stores or shipping.

Figure 4:
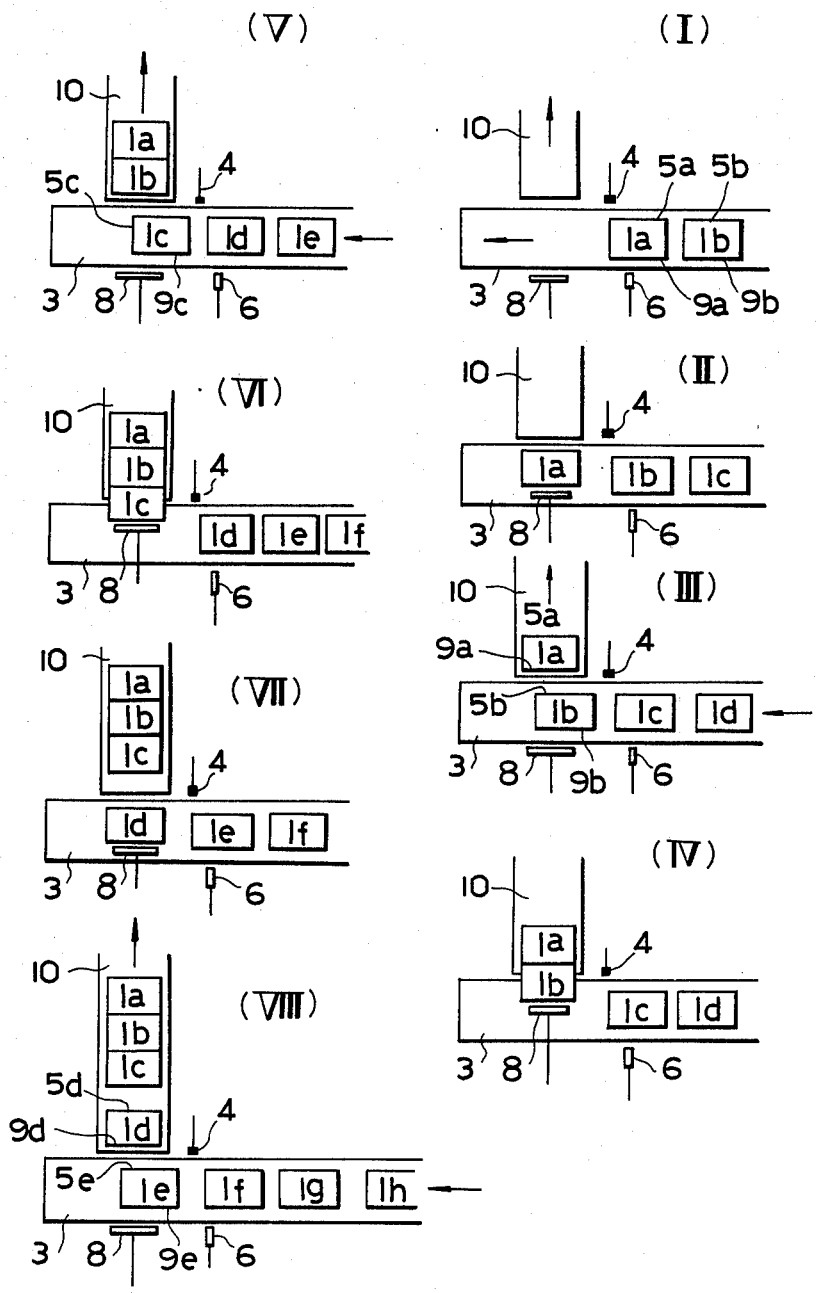
FIG. 4 (I) through 4(VIII) are explanatory views illustrating diagrammatically the flow of the unit boxes according to the present invention.

FIGS. 4(I) to 4(VIII) show steps in which three unit boxes are integrated according to an embodiment of the present invention. In FIG. 4(I), two unit boxes 1*a* and 1*b* are transferred in the direction of left hand in the figure by the conveyor 3. In FIG. 4(II), the unit box 1*a* comes to a predetermined position in front of the thrusting plate 8 and stopped thereat by the stopper (not shown). After the unit box 1*a* is thrust out onto the conveyor 10 by the plate 8, the next unit box 1*b* comes in position in front of the plate 8, as shown in FIG. 4(III). In FIG. 4(IV), the second unit box 1*b* is thrust onto the conveyor 10 and adhered to the first unit box 1*a* side by side. In FIGS. 4(V) and 4(VI), the third unit box 1*c* comes in position on the conveyor 3 and stopped by the stopper, thereafter being thrust to the conveyor 10. As a result, the front side of the third unit box 1*c* is adhered onto the backside of the second unit box 1*b*, thereby to become three collective boxes. The following every three unit boxes 1*d*, 1*e* and 1*f* are collected in the same manner, as briefly shown in FIGS. 4(VII) and 4(VIII).

In a method for producing collective packing boxes according to the present invention, it is not essential to apply the adhesive to the sides 5 of the unit boxes by the head 4 when they are conveyed on the conveyor 3. However, if the three unit boxes are adhered each other side by side as above-mentioned, it is effective for stabilizing the construction of large size collective packing boxes.

The forming plate 16 is actuated by a conventional air cylinder as in the thrusting plate 8. Of course, the thrusting plate 8 and the forming plate 16 can be actuated by any other means such as an electric or hydraulic means. It is preferable that the conveyors 3 and 10 are provided with a start-stop controlling device or a stopper operating in linkage with the controller 7 according to the selection-setting function of the latter, at an appropriate position to adjust the intervals of the unit boxes and synchronize the conveyor speeds with the motions of the thrusting plate or board 8 and the forming or pressing plate 16. Also, guide means is preferably provided along the conveyors 3 and 10 to guide the unit boxes precisely in a predetermined course although the guide means is not shown.

The heads 4, 13 and 14 for applying the adhesive can be composed of any conventional adhesive-applying means such as a spray type gun. However, it is most convenient to employ an adhesive-applying head which is designed to apply the liquid adhesive only when the front of the head comes in contact with the sides and the flaps of the unit boxes.

In order to ensure the inward bending of the flaps 12 of the unit boxes, it is preferable that the thrusting plate 8 is provided with a bending member (not shown) which functions to bend or fold one flap 12 of the unit box inwards when the plate 8 thrusts the boxes from the conveyor 3 to the conveyor 10. A guide or stopper (not shown) is preferably provided to precisely set a lid 2 at a predetermined position by the lid-supplying means which is controlled by the controller 7.

A roller type forming means can be employed in place of the forming plate 16 which is controlled by the controller 7. It is easy to actuate the roller type forming means independently from the controller 7.

FIGS. 5 through 9 show another unit boxes made according to the present invention.

Figure 5:
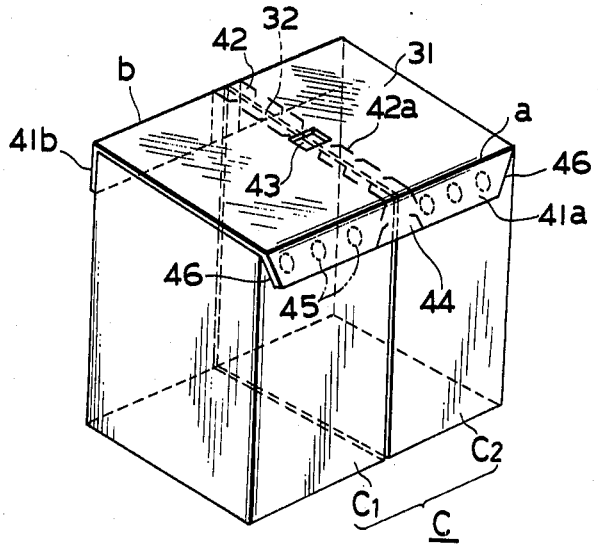
FIG. 5 is a perspective view showing another type of collective packing unit boxes produced according to the present invention.
Figure 9:
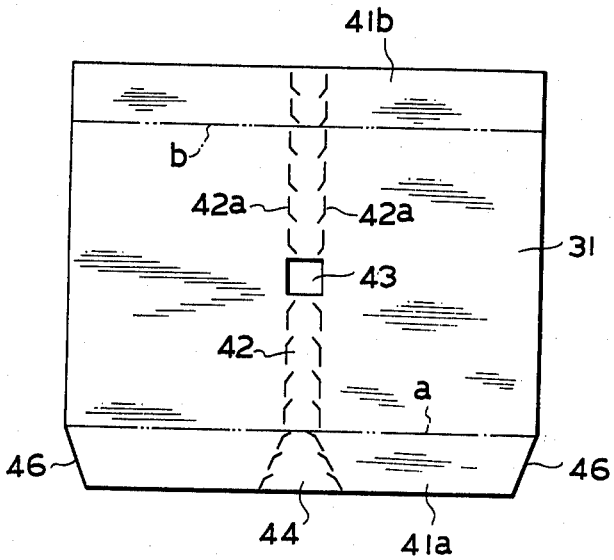
FIG. 9 is a developed view of a lid adhered to the collective unit boxes as shown in FIG. 5.

In FIG. 5, unit boxes C1 and C2 are collected. A common lid 31 is adhered to the top of the unit boxes. The lid 31 has two folding lines a and b near the opposite side edges thereof beyond which the flaps 41*a* and 41*b* extend, respectively. A cut portion 42 is formed on the position of the lid 31 corresponding to the connecting line between the two unit boxes C1 and C2. Such a cut portion 42 may be a notched line, dotted line or perforated line. One end 44 of the cut portion 42 is formed like V-shape as best shown in FIG. 9. The flap 41*a* has an inclined portion 46 at each end thereof in connection with the V-shaped portion 44. A rectangular window 43 is formed on the center of the cut portion 42 to facilitate pulling of the cut portion 42 by a finger. The substantially whole part of the flap 41*b* is adhered to the upper portion of one side of the collective unit boxes C1 and C2. However, the other flap 41*a* is adhered to the upper portion of the opposite side of the collective unit boxes at several spots 45 to facilitate opening of the flap 41*a* and the lid 31.

Figure 6:
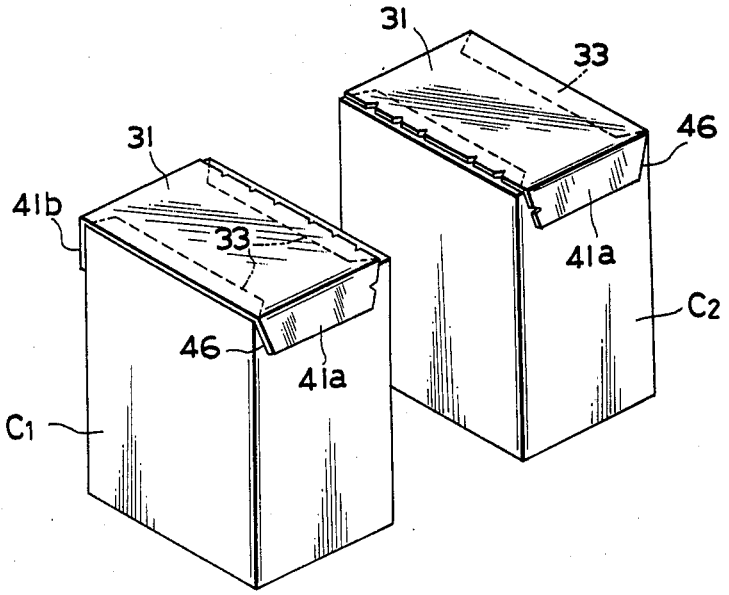
FIG. 6 is a perspective view showing a mode of the packing unit boxes as shown in FIG. 5 in which they are separated.
Figure 7:
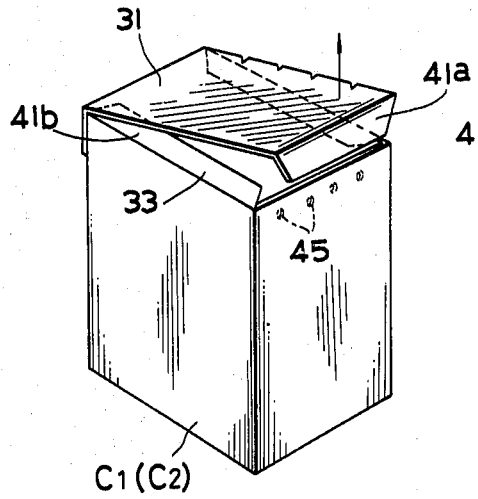
FIG. 7 is a perspective view illustrating one of the unit boxes as shown in FIG. 6 in which the top of the unit box is opened.
Figure 8:
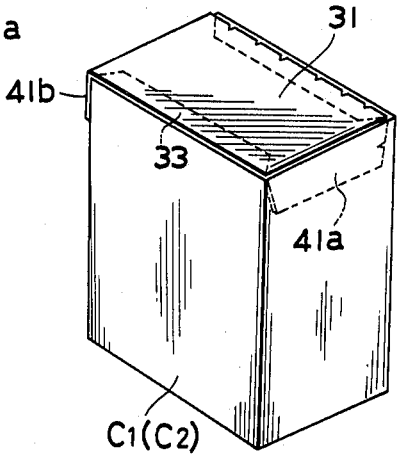
FIG. 8 is a perspective view showing the unit box as shown in FIG. 7 in which it is again closed.

In FIG. 6, the collective unit boxes C1 and C2 are separated by cutting away the cut portion 42 to become each an independent unit box. In FIG. 7, such a unit box C1 or C2 is opened for purposes of labeling or others. In FIG. 8, the unit box C1 or C2 is again closed after labeling or others.

According to the present invention, it is easy to produce continuously and efficiently collective packing boxes by the combination of relatively simple conventional means. Also, any number of collected unit boxes can be manufactured. Thus its contribution to the rationalization of packing industry is indeed great.

While the present invention has been described by referring to specific embodiments of the present invention chosen for purposes of illustration, it should be apparent that other embodiments and numerous modifications could be made thereto by those skilled in the art without departing from the spirit and scope of the present invention.

What is claimed is:

1. A process for automatically producing collective packing boxes, comprising the steps of:

feeding a plurality of unit boxes in a first direction by a first conveyor;

detecting the unit boxes when they come to a predetermined position along the first conveyor in the first direction, so as to send a detecting signal to a controller;

daubing an adhesive to the unit boxes selected by a predetermined number on a side portion thereof according to a control signal from the controller;

thrusting the unit boxes one by one from the first conveyor to a second conveyor in a second direction perpendicular to the first direction, thereby to cause the front side of each unit box to contact with the back side of the immediately preceding box;

collecting a predetermined number of the unit boxes together when the unit boxes are thrust from the first conveyor to the second conveyor;

bending by a bar two top flaps extending from the opposite top edges of the collected unit boxes inwards when the unit boxes are conveyed by the second conveyor;

daubing an adhesive on the top flaps of the unit boxes selected by a predetermined number according to a control signal from the controller after the top flaps of the unit boxes are bent;

daubing an adhesive on the upper portions of the two opposite sides of each unit box perpendicular to the contacting sides thereof according to a control signal from the controller;

feeding a common lid to the top of the collected predetermined number of unit boxes;

pressing the common lid onto the top of the collected predetermined number of unit boxes so that the lid is adhered on the top flaps of the collected unit boxes at the same time; and folding the two opposite side edges of the lid so that the side edges thereof are adhered on the upper portions of the two sides of the collected unit boxes.

2. A process as defined in claim 1 wherein the top flaps of the unit boxes are maintained to be bent inwards by a flap bending means when the lid is adhered onto the collected unit boxes.

3. A process as defined in claim 1 wherein a cut portion of the lid is positioned in alignment with a connecting line between the unit boxes.

4. A process for automatically producing collective packing boxes, comprising the steps of:

feeding a plurality of unit box bodies having the closed bottom end thereof and the open top end thereof in a first direction by a first conveyor;

daubing an adhesive to the unit box bodies selected by a predetermined number on a side portion thereof;

thrusting the unit box bodies one by one from the first conveyor to a second conveyor in a second direction perpendicular to the first direction, thereby to cause the front side of each unit box body to contact with the back side of the immediately preceding unit box body;

collecting a predetermined number of the unit box bodies together;

bending inwardly a pair of top flaps provided at the opposite top edges of the front and back sides of the collected unit box bodies where the unit box bodies are bonded to each other;

daubing an adhesive on the upperside of the top flaps of the collected unit box bodies;

daubing an adhesive on the upper portions of the two opposite sides of the collected box bodies perpendicular or adjacent to the contacting or bonded sides of the unit box bodies;

pressing a common lid at its front and back edges onto the top flaps of the unit box bodies so that the common lid is adhered onto the top flaps of the unit box bodies; and pressing a pair of flaps provided at the other edges of the unit box bodies onto the upper portions of the unit box bodies so that the flaps of the common lid are adhered thereto;

whereby the unit box bodies can be divided or separated into each independent unit box having a small lid or top cover which can be repeatedly used to close the top opening of the unit box body.

5. A unit box produced by the method of claims 1 or 4.

6. An apparatus for automatically making collective packing unit boxes each having a hexahedral box body with an open top thereof and two top flaps extending from the opposite top edges of the box body;

a first conveyor for conveying a number of unit boxes in a first direction;

a second conveyor for conveying the unit boxes in a second direction perpendicular to the first direction;

means for thrusting the unit boxes from the first conveyor to the second conveyor when each unit box comes to a predetermined position;

a detector provided along the first conveyor for detecting the unit boxes when they come to a predetermined position on the first conveyor in the first direction;

a first adhesive applying head for applying an adhesive on a side portion of unit boxes selected by a predetermined number, the first adhesive applying head being placed along the first conveyor next to the detector;

a bar placed above the second conveyor and extending in the second direction for bending the top flaps of the unit boxes inwards during the transfer of the unit boxes collected by a predetermined number on the second conveyor in the second direction;

a second adhesive applying head placed along the second conveyor in connection with the bar for daubing an adhesive on the top flaps of the unit boxes selected by the predetermined number during the transfer of the unit boxes on the second conveyor;

a third adhesive applying head placed along the second conveyor in connection with the bar for daubing an adhesive on the upper portions of the two opposite sides of each unit box perpendicular to the contacting sides thereof;

means for feeding a common lid to the top of the collected unit boxes when they are conveyed by the second conveyor in the second direction;

means placed next to the feeding means above the second conveyor for pressing the common lid onto the top of the collected unit boxes and further folding or bending the two opposite side edges of the lid outwardly so that the lid can be adhered on the top flaps of the collected unit boxes and the upper portions of the sides thereof;

means for feeding the adhesive to the first, second and third adhesive applying heads; and means for controlling the first adhesive applying head upon receipt of a detecting signal from the detector in such a way that the adhesive can be applied to only a predetermined number of unit boxes.

* * * * *